US008251769B2

(12) United States Patent
Cao

(10) Patent No.: US 8,251,769 B2
(45) Date of Patent: Aug. 28, 2012

(54) SIMULATED EYE ASSEMBLY FOR USE IN TOY

(75) Inventor: Xiong-Gang Cao, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 254 days.

(21) Appl. No.: 12/752,133

(22) Filed: Apr. 1, 2010

(65) Prior Publication Data

US 2011/0034104 A1 Feb. 10, 2011

(30) Foreign Application Priority Data

Aug. 10, 2009 (CN) ..... 2009 1 0305435

(51) Int. Cl.
*A63H 3/40* (2006.01)

(52) U.S. Cl. ..... 446/343; 446/392

(58) Field of Classification Search ..... 446/301, 446/337–350, 372, 383, 393
See application file for complete search history.

(56) References Cited

U.S. PATENT DOCUMENTS

| | | | | |
|---|---|---|---|---|
| 3,353,296 | A * | 11/1967 | Ryan et al. | 446/344 |
| 4,900,289 | A * | 2/1990 | May et al. | 446/342 |
| 5,399,115 | A * | 3/1995 | Arad et al. | 446/342 |
| 7,189,137 | B2 * | 3/2007 | Ellman et al. | 446/304 |
| 2007/0293325 | A1 * | 12/2007 | Matsumoto et al. | 464/104 |
| 2009/0114059 | A1 * | 5/2009 | Chu et al. | 74/661 |
| 2010/0136879 | A1 * | 6/2010 | Yang | 446/343 |

* cited by examiner

*Primary Examiner* — Nini Legesse
(74) *Attorney, Agent, or Firm* — Altis Law Group, Inc.

(57) ABSTRACT

A simulated eye assembly is provided. The simulated eye includes a motor, a first ball, and a first slider-crank transmission mechanism. The transmission mechanism comprises a slider connected to the motor, and a first crankshaft connected to the first ball. The slider is driven by the motor to cause the first crankshaft to rotate, which further causes the first ball to rotate.

9 Claims, 4 Drawing Sheets

SIMULATED EYE ASSEMBLY FOR USE IN TOY

BACKGROUND

1. Technical Field

The present disclosure relates to simulated eyes and, more particularly, to a simulated eye assembly for use in combination with a toy.

2. Description of Related Art

Dolls and plush toys have for many years been a popular toy category. Because the eye construction represents an important factor in the success of dolls and plush toys, practitioners in the art have endeavored to provide a variety of simulated eyes. While a great variety of simulated eye structures are provided, there remains, nonetheless, a continuing need in the art for evermore interesting and improved simulated eyes for use in dolls and plush toys.

DETAILED DESCRIPTION

Figure 1:
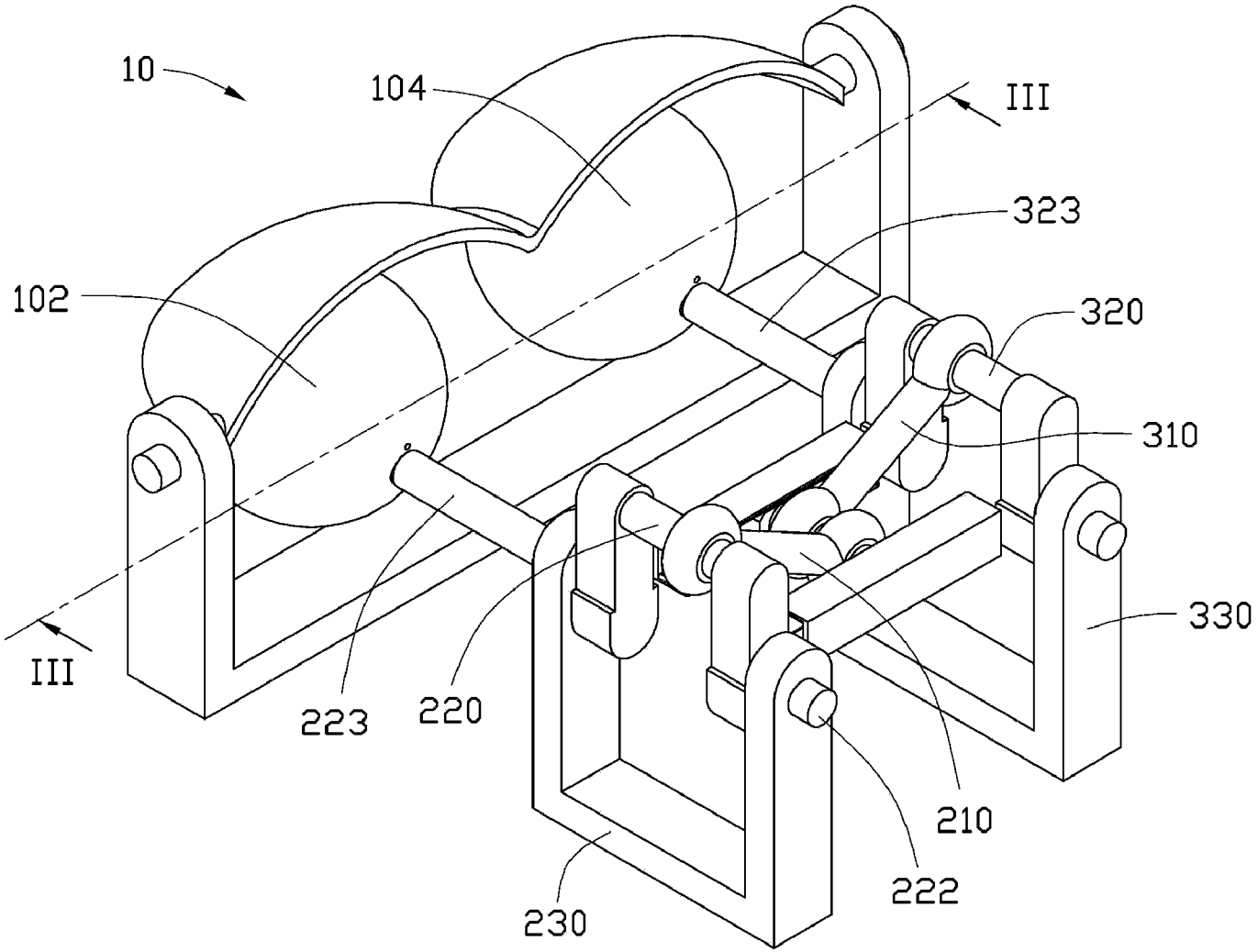
FIG. 1 is an isometric view of a simulated eye assembly for use in combination with a toy, in accordance with an exemplary embodiment.
Figure 2:
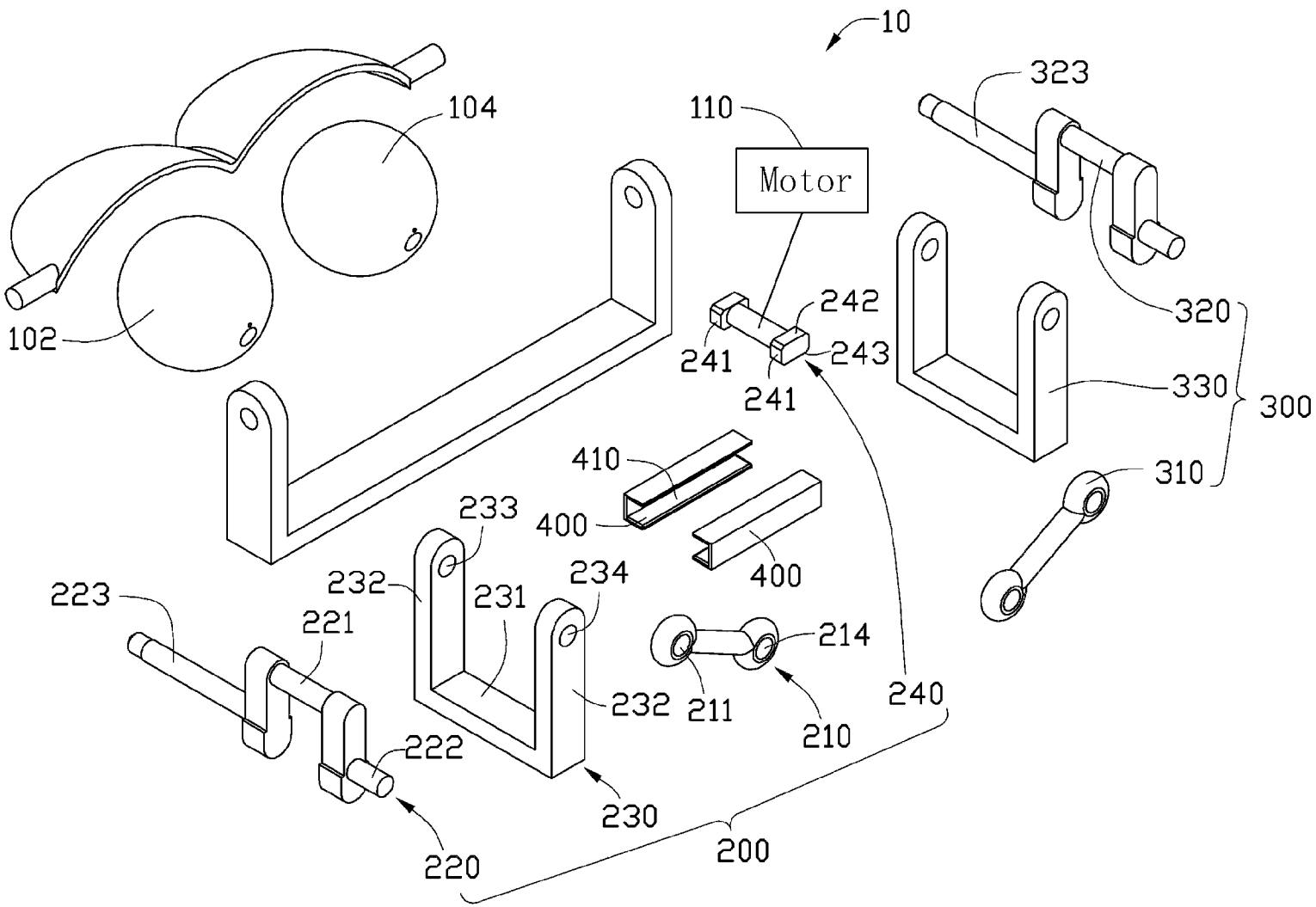
FIG. 2 is an exploded view of the simulated eye assembly of FIG. 1.

Referring to FIGS. 1 and 2, a simulated eye assembly 10 for use with a toy includes a first ball 102 and a second ball 104 to simulate the human eyes. The eye assembly 10 also includes a first transmission mechanism 200 and a second transmission mechanism 300, which are used to transmit motion from a linear motor 110 to the balls 102 and 104. The balls 102 and 104 can thus rotate to simulate movement of real eyes.

The transmission mechanisms 200 and 300 have the same construction and are slider-crank mechanisms that transmit linear motion to circular motion. The mechanisms 200 and 300 both include connecting rods 210, 310, crankshafts 220, 320, frames 230, 330, and one common slider 240. The frames 230, 330 have the same structure and can be fixed to a proper position of the toy. The frame 230 includes a base bar 231 and two side bars 232 spaced from each other that protrudes from the base bar 231.

Two guiding members 400 arranged between the frames 240, 340 each define a sliding groove 410. The guiding members 400 may be fixed to a component of the toy or fixed to the slide bars of the frames 230, 330. The sliding grooves 410 face each other and are used to receive one end of the slider 240, such that the slider 240 can slide along the sliding grooves 410.

The shape and structure of the crankshafts 220, 320 are identical. The crankshaft 220 includes a main shaft 221 and two crankpins 222, 223 connected to two ends of the main shaft 221. The crankpins 222, 223 extend through through holes 233 and 234 formed in the side bars 242, respectively, which rotatably connects the crankshaft 220 to the frame 230. The first ball 102 is fixed to a distal end 224 of the crankpin 223 to rotate together with the crankpin 223. The crankshaft 320 is rotatably connected to the frame 340 in the same manner as the crankshaft 220. Similarly, the first ball 104 is connected to a distal end of a crankpin 323 of the crankshaft 320.

Figure 3:
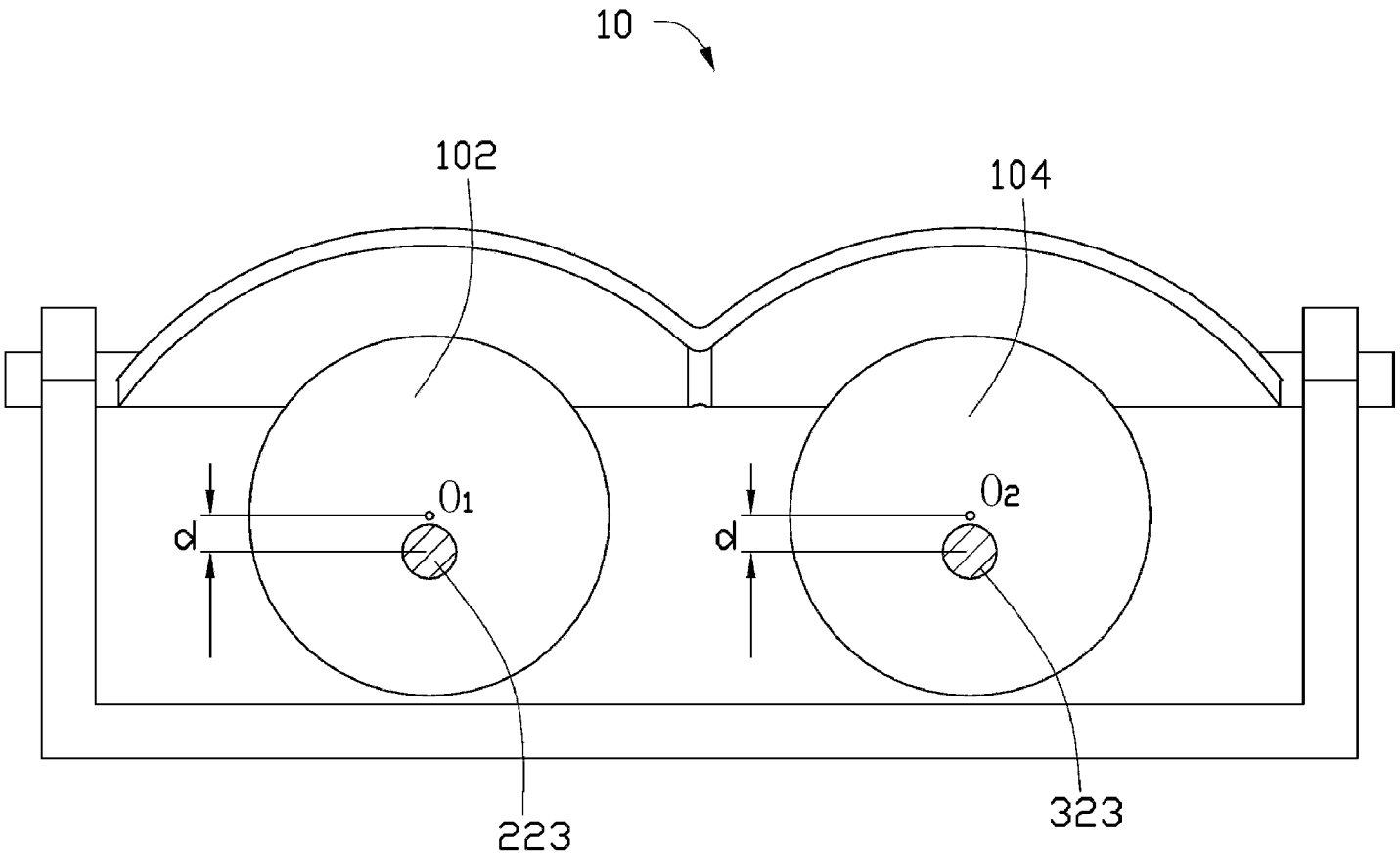
FIG. 3 is a cross-sectional view of the simulated eye assembly of FIG. 1, which is taken along line of FIG. 1.

Referring to FIG. 3, the rotating axes of the crankpins 223 and 323 are spaced a distance d from ball centers O1 and O2 of the balls 102 and 104. In this way, the balls 102 and 104 will rotate leftward or rightward about their rotating axis, rather than the ball centers O1 and O2, which more realistically simulates real eye movement.

The shape and structure of the connecting rod 210, 310 are identical. The rod 210 defines two through holes 211 and 214 at two ends, such that the rod 210 can be pivotably connected to the main shaft 221 and the slider 240. Similarly, the rod 310 is pivotably connected to the main shaft of the crankshaft 320 and the slider 240.

The slider 240 is a rod that includes two ends 241. The ends 241 each include an upper planar surface 242 and a lower planar surface 243 that are parallel to each other. The distance between the surfaces 242 and 243 is slightly less than the height of the groove 410 of the guiding member 400, such that the slider 240 can be slidable along the groove 410. The slider 240 is also connected to the linear motor 100 to be driven to slide with respect to the guiding members 400.

Figure 4:
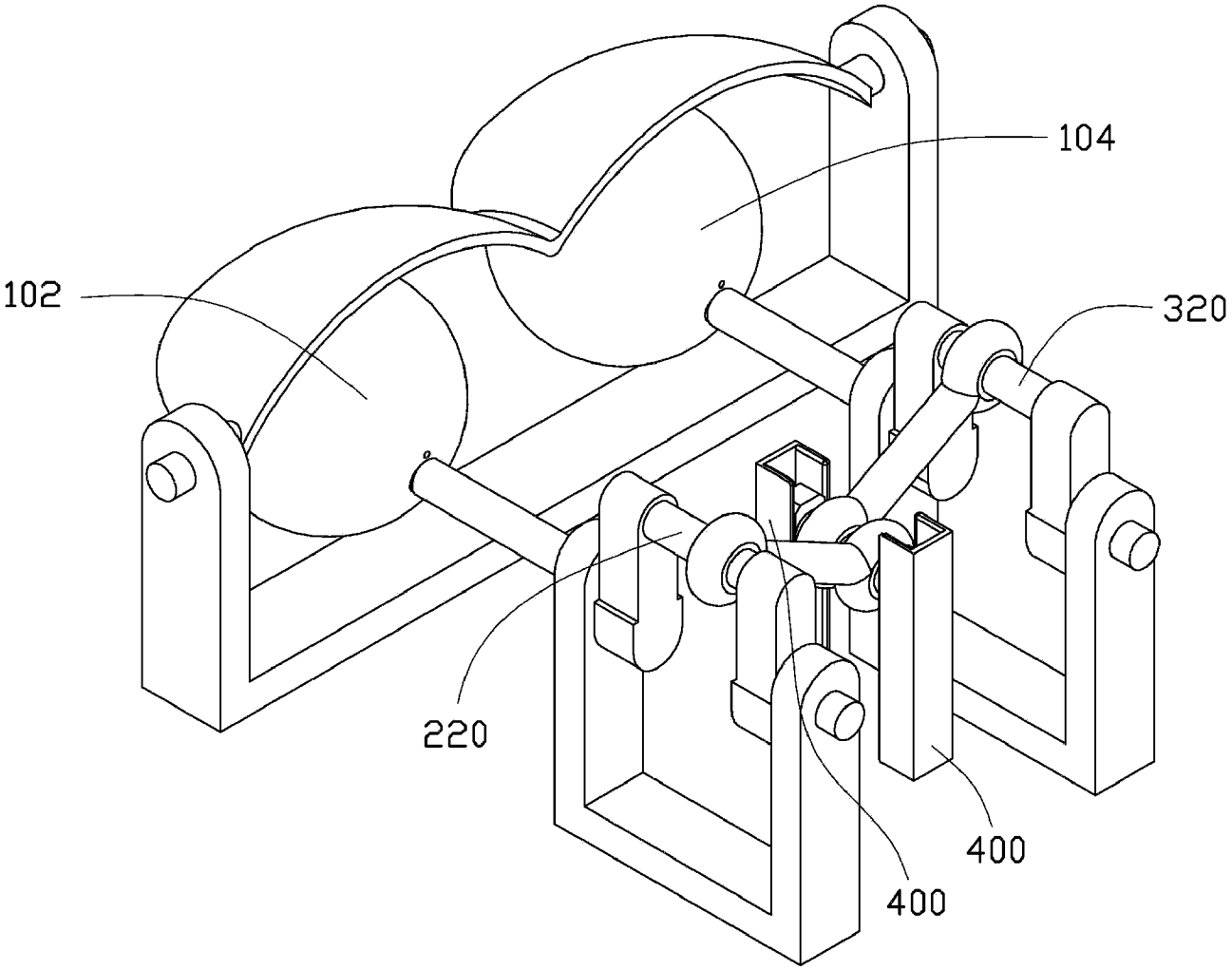
FIG. 4 is an isometric view of a simulated eye assembly for use in combination with a toy, in accordance with another exemplary embodiment.

In the exemplary embodiment, the guiding members 400 are arranged to guide the slider 240 to move horizontally, which causes the crankshafts 220, 320 to rotate in the same direction. The balls 102 and 104 thus rotate in the same direction. In another embodiment as shown in FIG. 4, the guiding members 400 may be arranged to guide the slider 240 to move vertically, which causes the crankshafts 220, 320 to rotate in opposite directions. The balls 102 and 104 thus rotate in opposite directions.

While various embodiments have been described and illustrated, the disclosure is not to be constructed as being limited thereto. Various modifications can be made to the embodiments by those skilled in the art without departing from the true spirit and scope of the disclosure as defined by the appended claims.

What is claimed is:

1. A simulated eye assembly for use in combination with a toy, comprising:

a motor;

a first ball;

a first slider-crank transmission mechanism comprising a slider connected to the motor, and a first crankshaft connected to the first ball, wherein the slider is driven by the motor to cause the first crankshaft to rotate, which further causes the first ball to rotate;

wherein the motor is a linear motor to drive the slider to slide.

2. A simulated eye assembly for use in combination with a toy, comprising:

a motor;

a first ball;

a second ball; and two transmission mechanisms sharing one slider connected to the motor, each of the two transmission mechanisms comprising a crankshaft, the crankshafts of the two transmission mechanisms being respectively connected to the first ball and the second ball, wherein when the slider is directly driven to slide by the motor, the crankshafts of the two transmission mechanisms are caused to rotate, which causes the first ball and the second ball to rotate.

3. The toy according to claim 2, wherein the motor is a linear motor.

4. The toy according to claim 2, wherein each of the two transmission mechanisms comprises a frame and a connecting rod, two ends of the connecting rod are pivotably connected to the slider and the corresponding crankshaft, and the crankshaft comprises a crankpin, the first ball and the second ball are secured to the crankpins of the two transmission mechanisms.

5. The toy according to claim 4, further comprising two guiding members, wherein, each of the two guiding member defines a groove to receive one end of the slider to allow that the slider is slidable with respect to the two guiding members.

6. The toy according to claim 5, wherein the two guiding members are arranged to guide the slider to slide horizontally to cause the crankshafts of the two transmission mechanisms to rotate in the same direction.

7. The toy according to claim 5, wherein the two guiding members are arranged to guide the slider to slide vertically to cause the crankshafts of the two transmission mechanisms to rotate in opposite directions.

8. The toy according to claim 4, wherein a ball center of each of the first ball and the second ball is spaced from a rotating axis of the crankpin corresponding thereto.

9. The toy according to claim 4, wherein the frame comprises a base bar and two side bars protruding therefrom, and the crankshaft is rotatably connected to the two side bars.

* * * * *